US005635797A

United States Patent [19]

Kitakaze et al.

[11] Patent Number: 5,635,797

[45] Date of Patent: Jun. 3, 1997

[54] MAGNETRON WITH IMPROVED MODE SEPARATION

[75] Inventors: Seiji Kitakaze, Mobara; Yuichi Ito, Isumi-gun; Toshio Ogura, Mobara; Tomokatsu Oguro, Mobara; Iwao Umeki, Mobara; Masumi Kuga, Chousei-gun, all of Japan

[73] Assignees: Hitachi, Ltd., Tokyo; Hitachi Device Engineering Co., Ltd.; Hitachi Electronic Devices Co., Ltd., both of Chiba-ken, all of Japan

[21] Appl. No.: 397,881

[22] Filed: Mar. 2, 1995

[30] Foreign Application Priority Data

Mar. 9, 1994 [JP] Japan ..... 6-038368

[51] Int. Cl.[6] ..... H01J 25/50; H01J 23/05

[52] U.S. Cl. ..... 315/39.51; 315/39.75

[58] Field of Search ..... 315/39.51, 39.75

[56] References Cited

U.S. PATENT DOCUMENTS

| | | | |
|---|---|---|---|
| 2,765,425 | 10/1956 | Millman | 315/39.75 X |
| 2,810,094 | 10/1957 | Derby et al. | 315/39.55 |
| 3,944,872 | 3/1976 | Wilbur et al. | 315/39.51 |
| 4,410,833 | 10/1983 | Ganguly et al. | 315/39.75 X |
| 4,855,645 | 8/1989 | Kinuno et al. | 315/39.51 X |
| 5,049,782 | 9/1991 | Aiga et al. | 315/39.75 X |

FOREIGN PATENT DOCUMENTS

| | | | |
|---|---|---|---|
| 4215231 | 8/1992 | Japan | 315/39.51 |

*Primary Examiner*—Benny T. Lee

*Attorney, Agent, or Firm*—Antonelli, Terry, Stout & Kraus, LLP

[57] ABSTRACT

A magnetron having eight anode vanes (2) arranged radially inside an anode cylinder (3) and a helically coiled, directly heated filament positioned along the anode cylinder. The magnetron oscillates at a basic frequency of 2450 MHz. The external diameter of the helically coiled, directly heated filament is in the range of 2.6 to 3.2 mm, and the diameter between the internal ends of the anode vanes is in the range of 7.0 to 8.0 mm.

17 Claims, 17 Drawing Sheets

Conditions:
V. S. W. R≦1.1
Ib=300mA

Conditions:
V. S. W. R≦1.1
Ib=300mA

Conditions:
V. S. W. R≦1.1
Ib=300mA

Conditions:
V. S. W. R≦1.1
Ib=300mA

FIG. 10

| Load (water) | 8-vane Magnetron | | | 10-vane Magnetron | | |
|---|---|---|---|---|---|---|
| | Pabs (W) | Win (W) | $\eta$oven (%) | Pabs (W) | Win (W) | $\eta$oven (%) |
| 2000cc | 460 | 912.5 | 50.4 | 460 | 925 | 49.7 |
| 1000 | 425 | 912.5 | 46.6 | 446 | 925 | 48.2 |
| 500 | 404 | 912.5 | 44.3 | 411 | 925 | 44.4 |
| 275 | 374 | 925 | 40.4 | 362 | 925 | 39.1 |
| 100 | 285 | 937.5 | 30.4 | 276 | 950 | 29.1 |

Pabs :Oven Output
Win :Oven Input
$\eta$oven:Pabs/Win × 100

FIG. 11

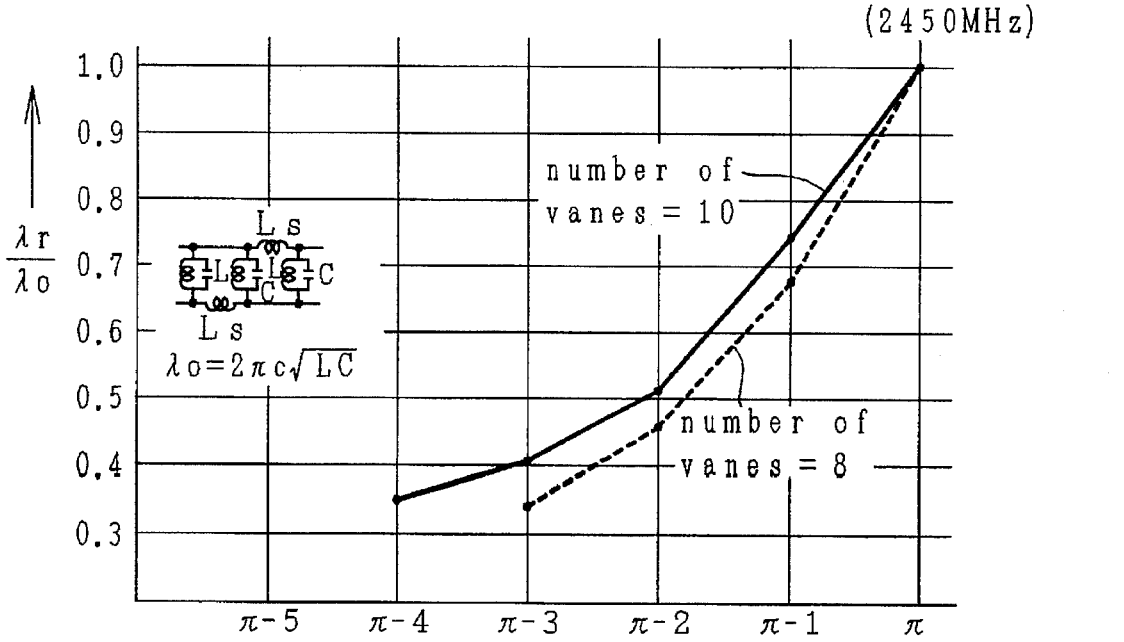

$$\frac{\lambda r}{\lambda o}=\frac{1}{\sqrt{1+\sigma\{1+\mathrm{Cos}(2\pi n/N)\}}}$$

Calculated as $\sigma=2L/Ls=4.0$ where

Ls=inductance of a portion of a strap ring between points connected to alternate vanes, L =inductance of an anode cavity, C =capacitance of an anode cavity N =the number of vanes $\lambda r$=a resonant frequency c =light speed $\lambda o$=wavelength of $\pi$-mode oscillation n =the number of modes

MAGNETRON WITH IMPROVED MODE SEPARATION

BACKGROUND OF THE INVENTION

This invention relates to magnetrons used for microwave application, especially to magnetrons having an anode-cathode structure in which the number of resonant cavities comprising the anode of the magnetron can be reduced and stable microwave output can be obtained.

Since magnetrons can generate microwave power efficiently, they are used widely for radar equipment, medical devices, cooking devices such as microwave ovens, and other microwave devices.

Such magnetrons comprise a body having resonant cavities and a microwave output unit, and a filter that suppresses microwaves leaking from a power supply portion that supplies power to the body.

The number of resonant cavities is usually twelve which are formed by twelve anode vanes. Recently, a ten-cavity resonator formed by ten anode vanes was proposed.

FIG. 12 shows a cross section of a conventional magnetron structure example. 1 is a filament, 2 is anode vanes, 3 is an anode cylinder, 4 and 4' are permanent magnets, 5 and 5' are pole pieces, 6 and 6' are yokes, 7 is an antenna lead, 8 is an antenna, 9 is an exhaust tube, 9*a* is a concave portion formed by sealing off the exhaust tube 9, 10 is an antenna cover, 11 is a cylindrical insulator, 12 is an exhaust tube support, 21 is an upper end shield, 21' is a lower end shield, 23 and 24 are filament leads, 25 is an input side ceramic body, 126 is a filament terminal, 27 is a spacer, 28 is a sleeve, 31 is a choke coil, 32 is a feed-through type condenser. 33 is a filter case, 34 is a cover, 35 and 35' are sealing parts, 41 is an upper sealing part, 42 is a lower sealing part, 43 is a metallic gasket, and 45 is a cooling fin.

In FIG. 12, plural anode vanes 2 are arranged radially around the cathode filament 1 to form resonant cavities. These anode vanes 2 are brazed to the anode cylinder 3 or press-formed integrally with the anode cylinder.

Above and under the anode cylinder 3 are arranged magnetic pole pieces 5 and 5', formed of high permeability material such as soft-iron, and cylindrical permanent magnets 4 and 4'. The magnetic fluxes generated from the permanent magnets 4 and 4' pass through the magnetic pole pieces 5 and 5' and into the interaction space formed between the cathode filament 1 and the anode vanes 2 to provide an axial DC magnetic field.

The yokes 6 and 6' form a magnetic circuit for the magnetic fluxes from the permanent magnets 4 and 4' with the magnetic pole pieces 5 and 5'.

The electrons emitted from the cathode filament 1 at a negative high potential make a circular motion under the electric field and the direct magnetic field and generate a microwave field in each anode vane 2.

FIG. 13 shows a top view of the conventional magnetron anode structure shown in FIG. 12. 2*a* and 2*b* are cutouts formed in anode vanes 2 and 2'. 61 is a first strap ring and 62 is a second strap ring. The same parts as those shown in FIG. 12 are given the same reference numerals in this figure.

In FIG. 13, the anode vanes are divided into two groups, which are arranged alternately as 2 and 2'. These anode vanes 2 and 2' are radially arranged from the inside wall toward the axis 0 of the anode cylinder 3.

The anode vanes 2 and 2' are connected to each other alternately through first and second annular strap rings of different diameters 61 and 62, respectively, soldered to vanes at the cutouts thereof 2*a* and 2*b*. These strap rings are also arranged at the bottom ends of the anode vanes in the same way.

FIGS. 14(*a*) and 14(*b*) illustrate the strap rings shown in FIG. 13. FIG. 14 (*a*) shows a perspective view of the first strap ring of a small diameter, and FIG. 14 (*b*) shows a perspective view of the second strap ring of a large diameter. As shown respectively in FIGS. 14 (*a*) and 14 (*b*), both the first and second strap rings 61 and 62 are annular, but rectangular in cross section.

FIG. 15 shows a cross section of an essential part of an anode vane to explain how the anode vanes are connected to the strap rings. The same parts as those shown in FIGS. 12 through 14 are given the same reference numerals in this figure.

The small diameter strap ring 61 is in contact with the cutout 2*a* of this anode vane 2, while the large diameter strap ring 62 is not in contact with it. One of the anode vanes shown in FIG. 13 is silver-soldered to an antenna lead 7 (FIG. 12) used to receive microwaves.

The microwave field generated in the resonant cavities formed by the anode vanes 2 and 2' is led by the antenna lead 7 to the antenna 8, then transmitted through the antenna cover 10 that protects the antenna 8. The antenna 8 is integrated with a choke 9 used to prevent unnecessary radiation.

In general, the cathode filament that emits electrons is made of tungsten that contains a very small quantity of thorium oxide ($ThO_2$), in view of the electron emissivity, workability, etc.

The upper end shield 21 and the lower end shield 21' are supported by the cathode leads 23 and 24. In general, molybdenum (Mo) is adopted for these end shields and the filament leads, considering heat resistance and workability. The two filament leads 23 and 24 are supported by input side ceramic 25. The filament leads 23 and 24 are silver-soldered vacuum-tight to the input side ceramic 25 via the terminal plates 26.

When vibration, shock, or something similar is applied to the magnetron, the filament leads 23 and 24 vibrate. In addition, since the vibration mode differs between the filament leads 23 and 24, a mechanical stress is generated in the cathode filament 1. This may cause the cathode filament 1 to snap in some cases.

The spacer 27 is used to prevent this snapping of the filament 1. This spacer 27 is very effective to make both the filament leads 23 and 24 vibrate almost in the same mode when the filament leads vibrate. As a result, almost no stress is applied to the cathode filament. The sleeve 28 is used to fix the spacer 27 at the desired position.

FIG. 16 shows a cross section of a conventional magnetron structure to explain another embodiment. 26 is a terminal plate. The same parts as those shown in FIG. 12 are given the same reference numerals in this figure.

In FIG. 16, plural anode vanes 2 are brazed to the anode cylinder 3 around the helically coiled cathode filament 1, or plural anode vanes 2 are press-formed integrally with the anode cylinder 3.

Above and under the anode cylinder 3 are arranged the magnetic pole pieces 5 and 5', made of high permeability material such as soft iron, and annular permanent magnets 4 and 4'.

The magnetic fluxes generated from the permanent magnets 4 and 4' pass through the magnetic pole pieces 5 and 5' and into the interaction space formed between the cathode filament 1 and the anode vanes 2 and provide an axial direct magnetic field.

The yokes 6 and 6' constitute a magnetic circuit for the magnetic fluxes from the permanent magnets 4 and 4' with the magnetic pole pieces 5 and 5'. The electrons emitted from the cathode filament 1 at a negative high potential make a circular motion under the electric field and the direct magnetic field and generate a microwave field in each anode vane 2.

The generated microwave field reaches the antenna 8 through the antenna lead 7, then it is outputted to external devices via the antenna cover 10.

The cathode filament 1 is supported by the upper end shield 21, the lower end shield 22, and the filament leads 23 and 24. The filament leads 23 and 24 are connected to the leads 23' and 24' which are connected to the choke coil 31, via the terminal plates 26 that are silver-soldered to the top surface of the input ceramic body 25.

On the underside of the magnetron body are provided the filter case 33, that encases both the choke coil 31 and the feed-through type condenser 32, and the cover 34 for the filter case.

The choke coil 31 connected to the leads 23' and 24' forms an L-C filter together with the feed-through type condenser 32 to suppress the low frequency components coming out via the cathode leads. High frequency components are shielded by the filter case 33 and the cover 34 for the filter case.

The cooling fins 45 arranged at the outer periphery of the anode cylinder 3 radiate the heat generated in the magnetron operation. FIG. 17 shows a top view of the conventional magnetron anode structure shown in FIG. 16. The same parts as those shown in FIG. 16 are given the same reference numerals in this figure.

In FIG. 17, anode vanes are divided into two groups 2 and 2', which are arranged alternately. The anode vanes 2 and 2' are arranged radially from the inside wall toward the axis of the anode cylinder 3.

The anode vanes 2 and 2' are connected alternately by first and second annular strap rings 61 and 62 at the upper and lower ends of the vanes, that is, the antenna-lead-side end and the filament-lead-side end. The first and second strap rings 61 and 62 are different in diameter from each other.

FIGS. 18 (*a*) and 18 (*b*) illustrate the strap rings shown in FIG. 17. FIG. 18 (*a*) shows a top view and a cross section of the first strap ring 61 of a small diameter. FIG. 18 (*b*) shows those of the second strap ring 62 of a large diameter. Strap rings 61 and 62 are connected to the anode vanes at the projections 61*a* or 62*a* formed at their inner or outer periphery as depicted in FIGS. 18(*a*) and 18(*b*), respectively.

FIG. 19 shows the cross section of the anode cylinder taken along line XIX—XIX in FIG. 17. The anode vanes 2 and 2' are connected alternately to each other through the strap rings 61 and 62, and the strap rings 61' and 62' shown in FIGS. 18 (*a*) and 18 (*b*).

Other parts in the configurations are all the same as those shown in FIG. 12, so the explanation is omitted here.

This kind of magnetron is disclosed, for example, in Japanese Utility Model Publications No. 56504/1982 and No. 25656/1988.

The conventional magnetron for microwave ovens adopts the above basic structure. The conventional twelve-anode-vane magnetron has to employ a large-diameter and thick-wall anode cylinder, resulting in use of a large amount of copper. Therefore, it is desirable to reduce the number of anode vanes and the cylinder diameter to provide material saving.

Japanese Utility Model Publication No. 25656/1988 disclosed a compact-cylinder anode magnetron that uses ten anode vanes. This magnetron for use in microwave ovens is intended for reduction of the size and weight of the tube, while preventing the Q of the cavity resonator from degrading, improving the overall power efficiency, and reducing the line noise.

The compact magnetron adopts a ratio F/G of the outer cathode diameter F to the diameter G between the radially internal ends of the anode of vanes in the range of F/G=0.38 to 0.47, to obtain stable microwave power, the practical diameter G between the radially internal ends of the anode vanes being 8.09 to 10.0 mm, and the practical outer cathode diameter F being 3.62 to 4.02 mm, but these practical values of G and F do not permit sufficient material savings.

This magnetron satisfies efficiency, load stability, and other properties required for use in microwave ovens, except for reduction in the size of the magnetron tube. When the number of anode vanes is reduced from ten to eight to further reduce the size of the magnetron tube, however, it becomes difficult to obtain microwave power output of several hundreds of watts efficiently and stably.

The frequency range prescribed for magnetrons used for microwave ovens are 2400 to 2500 MHz. And, the basic oscillation frequency of the magnetron is a 2450 MHz band. The microwave power outputs of magnetrons is usually a few hundreds of watts to 1,000 watts and is used mainly for home microwave ovens. However, since the actual oscillation spectrum has a band-like distribution, the frequency spectrum of magnetrons has insufficient margin for allowable microwave leakage value for the range of the 2400 to 2500 MHz. The performance required for the eight-vane compact-anode magnetron is as shown below. In order to obtain this performance, the band width of the oscillating frequency spectrum should be narrowed and microwave leakage should be reduced.

(1) The magnetron oscillates at the basic frequency of 2450 MHz in the $\pi$ mode. When the magnetron stability is low, however, the oscillation may become unstable. In other words, it may oscillate at a frequency band beyond 2450 MHz band. Especially, in the case of home microwave ovens, the load is food, and the load impedance changes significantly according to the weight and shape of the food. Thus, a well-stabilized magnetron is needed.

(2) The efficiency of microwave ovens (microwave output/input) is 50 to 55%. The magnetron oscillation efficiency to Obtain this efficiency must be about 70%. Thus, an efficiency of about 70% is required even when the number of vanes is reduced.

(3) For the magnetron used for microwave ovens, foods vary from heavy load foods to light load foods when viewed from the magnetron. Especially, for light load foods, the microwave power absorption is less, so most of the microwave power returns to the magnetron. The microwave returned to the magnetron is consumed by anode vanes, which results in an increase in the temperature of those vanes. To avoid this, therefore, the increase in the temperature of vanes must be suppressed by improving the thermal allowance of the vanes.

(4) The higher the pulling figure of a magnetron is, the more easily the magnetron can be used. In other words, the higher the magnetron pulling figure is, the more easily the microwave output can be obtained for a wide range of load impedances. This makes it easier to design cooking chambers for microwave ovens, which is the load for the magnetron. The pulling figure of the magnetron indicates a degree of ease in supplying microwave power output to a load. The higher the value is, the larger the microwave power that is supplied to the load; therefore the larger the allowance for designing an impedance becomes for a microwave oven, for instance. However, in general, the higher this pulling figure becomes, the lower the operating stability of the magnetron (peak anode current for maintaining a 2450 MHz band oscillation) becomes. In the case of the conventional magnetron, the pulling figure is designed taking the operating stability into consideration. In this invention, the pulling figure is set in the range of 130 to 170% of that of the conventional magnetron to improve ease of use without degrading the operating stability.

(5) Resource-saving is another important item required for magnetrons used for home microwave ovens. Oxygen-free copper is used for anode cylinders and anode vanes of magnetrons. Molybdenum is used for filament leads. Both materials are expensive. It is therefore desirable to reduce the amount of those materials, and to reduce magnetrons in size and weight.

When the number of vanes is reduced, the anode loss per vane becomes large naturally, and the temperature of the vane rises excessively. As a result, adsorbed gas is discharged from the anode vanes, which deteriorates the degree of vacuum inside the tube, the strap rings connected with the tip of each vane are damaged, and the reliability of the magnetron is degraded. When' the number of vanes is reduced, therefore, the thermal allowance coping with the problems should be taken into consideration for design of the vane structure.

(6) The oscillation frequency band allowed for the microwave oven magnetron is 2450≈50 MHz (2400 to 2500 MHz). The oscillation spectrum must be within this range.

SUMMARY OF THE INVENTION

The object of this invention is to provide an eight-anode-vane magnetron used for microwave ovens having improved configuration and size of electrodes to obtain stable microwave power output.

This invention is based upon experiments on anode vanes and filaments of compact eight-anode-vane magnetrons optimized for the requirements.

A first invention to achieve the object is a magnetron comprising eight anode vanes arranged radially inside an anode cylinder and a helically coiled, directly heated filament positioned along the center axis of the anode cylinder, wherein the outer diameter of the helically coiled, directly heated filament is in the range of 2.6 to 3.2 mm, and the diameter between internal ends of the vanes is in the range of 7.0 to 8.0 mm.

A second invention to achieve the object is a magnetron comprising eight anode vanes arranged radially inside an anode cylinder and a helically coiled, directly heated filament positioned along the center axis of the anode cylinder, wherein F/G is in the range of 0.32 to 0.46, where F is the outer diameter of the helically coiled directly heated filament, and G is the diameter between internal ends of the vanes.

The application of this invention is not limited to magnetrons for microwave ovens, but it can also be applied to magnetrons used as a microwave generating means for other microwave applications.

BRIEF DESCRIPTION OF THE DRAWINGS

FIG. 7 (*b*) shows an oscillation spectrum of a conventional ten-vane magnetron operated in a matching condition.

FIG. 10 indicates output characteristics of an eight-vane magnetron of the present invention and of the conventional ten-vane magnetron when load is varied in a 900W-class microwave oven.

FIG. 11 indicates the calculated results of relative oscillation frequencies in each mode for eight anode vanes and ten anode vanes (anode cavities).

DETAILED DESCRIPTION OF THE PREFERRED EMBODIMENTS

Figure 1:
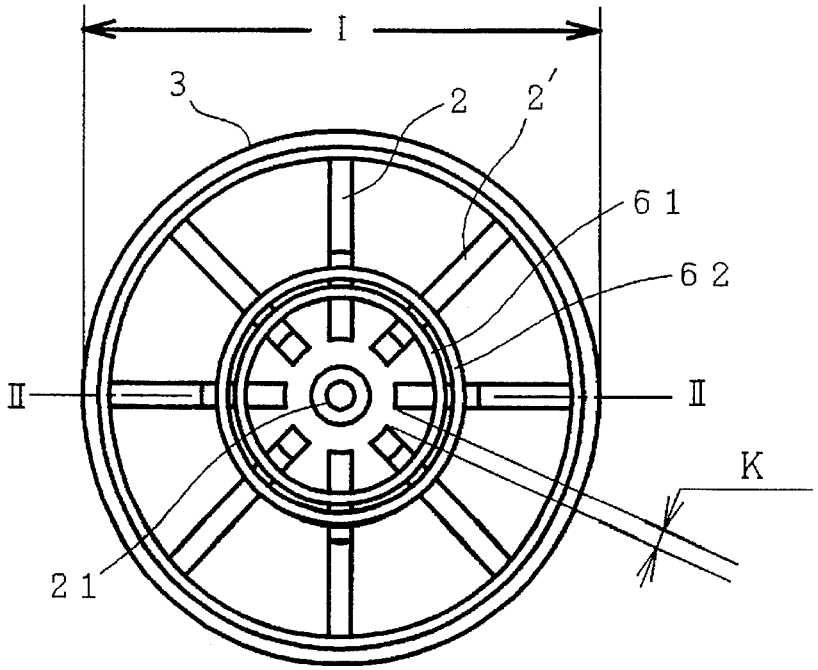
FIG. 1 shows a top view of essential parts of an anode and a cathode to explain a first embodiment of a magnetron of the present invention.

An anode of magnetron for use in microwave ovens comprises a cylinder and plural anode vanes made of expensive copper. To reduce the amount of the copper, it is effective to reduce the cylinder in diameter and the number of anode vanes.

As disclosed in the Japanese Utility Model Publication No. 25656/1988, a ten-vane anode type has been proposed in place of the conventional twelve-vane anode type that had been used for a long time. This type is put to practical use as magnetrons for microwave ovens.

At present, a trend in magnetrons is pursuing saving of global resources and ease of use. When a magnetron of an eight-vane anode type was studied from this point of view, it was found that resource-saving and stable oscillation in this type of magnetrons could be achieved by optimizing the diameter between internal ends of vanes (hereafter, to be referred to as the internal diameter of vanes) and the outer diameter of the cathode filament as mentioned above, and reducing the number of vanes and the diameter of the anode cylinder.

Magnetrons for microwave ovens use an oscillating frequency band of 2450 MHz, their microwave power output is several hundreds to one thousand watts, and they are mainly used for home microwave ovens.

Foods to be cooked in a home microwave oven vary in weight and shape, and so the microwave oven is a load having an impedance varying widely when viewed from the magnetron.

Thus, magnetrons are required to supply stable microwave power regardless of load.

The oscillation frequency band occupied by magnetrons, as mentioned above, is limited to within 2400 to 2500 MHz by statute. From this point of view, the range of frequencies at which magnetrons oscillate should be more narrow.

These requirements are related to a magnetron anode structure and the space between the filament cathode and the anode. In order to obtain stable microwave power, magnetrons must be free from moding; that is, stable in oscillation.

In general, in order to supply microwave power stably to a widely varying load impedance, the pulling figure of the magnetron must be increased. (The pulling figure is the difference between the maximum and minimum values of the oscillation frequency when the phase-angle of the load-impedance reflection coefficient varies through 360 degrees, while the absolute value of this coefficient is constant and equal to a specified value). In this case, moding often occurs as side effects; that is, degrading the stability of operation of the magnetron.

Moding means generation of abnormal oscillation in modes other than the mode at 2450 MHz. A magnetron having plural resonators oscillates with the number of modes corresponding to n/2 vanes when the number of vanes is n. When a normal oscillation mode is $\pi$ mode, oscillation modes become the $\pi$ mode, $\pi$-1 mode, $\pi$-2 mode, . . . , and $\pi$-n/2 mode. In order to improve moding characteristics (that is, oscillation stability) one effective method is to increase the difference in oscillating frequencies between the $\pi$ mode and the $\pi$-1 mode. Those modes are related to the anode cavity structure.

FIG. 11 illustrates the calculated results of the relative oscillation frequencies in different magnetron modes for eight- and ten-anode-vane (anode cavities) magnetrons. The horizontal axis indicates the oscillation mode, and the vertical axis indicates relative oscillation frequency.

As shown in the figure, the difference in oscillating frequencies between the $\pi$ mode and $\pi$-1 mode becomes larger and mode separation is more excellent when eight vanes are used than when ten vanes are used.

In other words, when eight-vanes are used, the magnetron operation stability can be improved.

As a result, the pulling figure of the magnetron, which conflicts with operation stability, that is, oscillation efficiency, can also be increased, resulting in stabler supply of microwave power.

A magnetron has plural resonators, and resonant characteristics vary with individual cavities, and the oscillation frequency spectrum is distributed like a band. This spectrum can be narrowed by reducing the number of plural cavities.

Oscillation frequency band width can be narrowed more effectively when an eight-vane magnetron is used than when a conventional ten-vane magnetron is adopted.

As explained above, when the number of anode vanes is reduced from ten to eight, the supply of microwave power becomes stabler and the oscillating frequency band width can be narrowed more effectively.

On the other hand, in a conventional technology disclosed in the Japanese Utility Model Publication No. 25656/1988, it is said that when the number of vanes is reduced from ten to eight, it becomes difficult to obtain stable microwave power output of a few hundreds watts. Basically, reducing the number of vanes seems to be effective to stabilize the magnetron operation. Of course, electrode geometry should be optimized to make the most of the advantageous more stable operation of the eight-vane magnetron.

Hereafter, some embodiments of this invention will be explained using the drawings.

Figure 2:
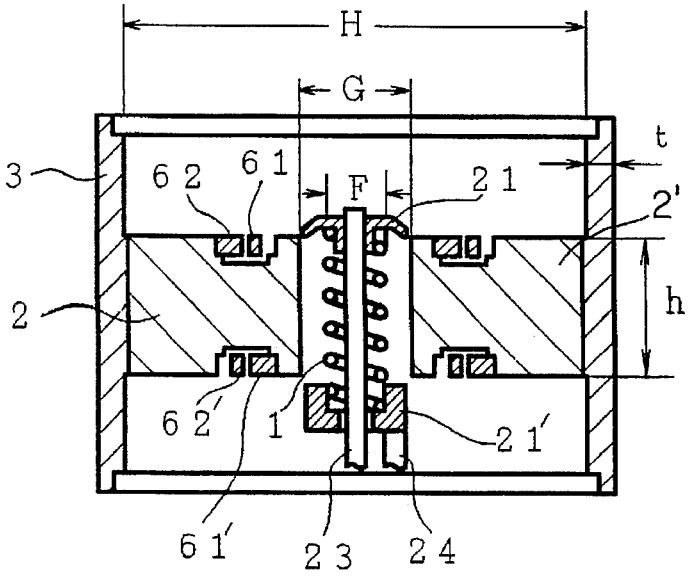
FIG. 2 shows a cross section of essential parts of the anode and the cathode and is shown along II—II in FIG. 1.

FIG. 1 shows a top view of the essential part of the anode and the cathode in a first embodiment of the magnetron of the invention. FIG. 2 shows the cross section of the essential part of the anode and the cathode taken along line II—II in FIG. 1. In FIGS. 1 and 2, 1 is a cathode filament, 2 and 2' are anode vanes, 3 is an anode cylinder, 21 is an upper end shield, 21' is a lower end shield, 23 and 24 are filament leads, 61 and 61' are first strap rings, and 62 and 62' are second strap rings.

In each figure above, eight anode vanes 2 and 2' made of copper of 2.0 mm in thickness and 8.0 mm in height are arranged radially inside the anode cylinder 3 which is made of copper of 2.0 mm in thickness. The vanes are connected to each other alternately at both axial ends through two types of strap rings 61 and 61' (first strap rings) and 62 and 62' (second strap rings) that are different in diameter.

In the center of the anode cylinder 3 is positioned the cathode filament (directly-heated helically coiled filament) 1. The two ends of this filament are fixed to the output-side end shield (upper end shield) 21 and to the input-side end shield (lower end shield) 21'. The output and input side end shields are supported by the rod-like filament supports 23 and 24.

Dimensions of an example of an eight-vane magnetron having an anti-moding and stably operating property are shown below.

F (outer diameter of the cathode filament)=2.8

G (diameter between internal ends of the vanes)=7.2 mm

H (internal diameter of the anode cylinder)=32 mm

I (outer diameter of the anode cylinder)=36 mm

The above values are only examples. As a result of detailed study, it has been found that practical dimensions of magnetrons for microwave ovens are as follows:.

The ratio F/G of the external diameter F of the filament to the diameter between the internal ends of the vanes is in the range of 0.32 to 0.46.

In order to reduce the diameter of the anode cylinder and to maintain stable oscillation at the same time, the ratio H/G of the internal diameter H of the anode cylinder to the diameter G between the internal ends of the vanes is desired to be about 4.4, and should usually be preferably in the range of 3.6 to 5.0, considering efficiency and oscillation frequency.

It has been experimentally found that the design of a eight-vane magnetron satisfying the above-mentioned ratio depends on how much the external diameter F of the filament can be reduced in view of its manufacturing process.

The magnetron for microwave ovens uses the helically coiled filament made of thoriated-tungsten to obtain satisfactory electron emissivity.

This helically coiled cathode is manufactured by winding a thoriated-tungsten wire around a mandrel whose diameter is equal to the internal diameter of the filament coil at a desired winding pitch while applying tension to the wire. Therefore, the smaller the coil diameter (the external diameter F of the filament) becomes, the more often the mandrel will be deformed or the filament wire will crack, resulting in lower mass-productivity.

The problems become more pronounced, the larger the wire diameter is. The filament wire diameter for 500 to 900 W microwave ovens is usually about 0.5 mm. With this wire diameter, it has been experimentally found that the minimum practical external diameter F of the filament is 2.6 mm.

Consider that the external diameter F of the filament is 2.8 mm. The F/G value should be larger for better performance. The value of 0.39 as F/G was chosen from the above-mentioned range in view of mass-productivity of vanes. Then G is 2.8/0.39≈7.2 mm. The experimental tube of these dimensions showed satisfactory microwave oscillation characteristics. The magnetron of this invention can be for practical use in microwave ovens of several hundreds to a thousand watts of microwave power in terms of oscillation stability and oscillation efficiency.

Thickness of anode vanes was also studied. The microwave electric field between tips of adjacent anode vanes becomes stronger with decreasing spacing K (FIG. 1) therebetween, resulting in improvement of stability against load variations. The minimum practical spacing K is 0.5 mm, considering ease of manufacture.

A filament of an external diameter F of 7.2 mm was considered. Then the thickness of the anode vanes is $(\pi\times7.2-0.5\times8)/8\approx2.3$ mm. For a ten-vane magnetron, the thickness of anode vanes is 1.8 mm. The total thickness of ten-anode-vanes is 18 mm, but the total thickness of eight-anode-vanes is $1.3\times8=18.4$ mm. The thermal allowance of the eight-vane magnetron is equal to that of the ten-vane magnetron.

Considering the thermal allowance of anode vanes, the thickness of each anode vane should be in the range of 2.0 to 2.4 mm, and the axial height should be in the range of 6.4 to 8.4 mm.

The frequency band legally prescribed for industrial, scientific, and medical applications is 2450≈50 MHz. The oscillation spectrum of magnetrons for microwave ovens must be within this range.

Oscillation spectrum of magnetrons has a band-like distribution due to variations in characteristics of individual cavity resonators of multi-cavity resonance system. In principle, the eight-vane-anode magnetron is more favorable for narrowing its spectrum due to the lower number of vanes than the ten-vane-anode magnetron. This was experimentally proved.

Figure 3:
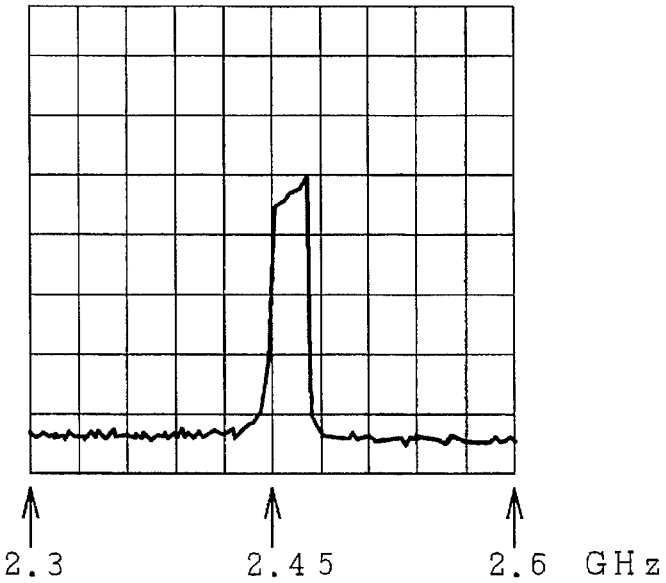
FIG. 3(*a*) illustrates a basic wave spectrum of the first embodiment of the eight-vane magnetron of the present invention, and FIG. 3 (*b*) illustrates a basic wave spectrum of a conventional ten-vane magnetron.
Figure 3:
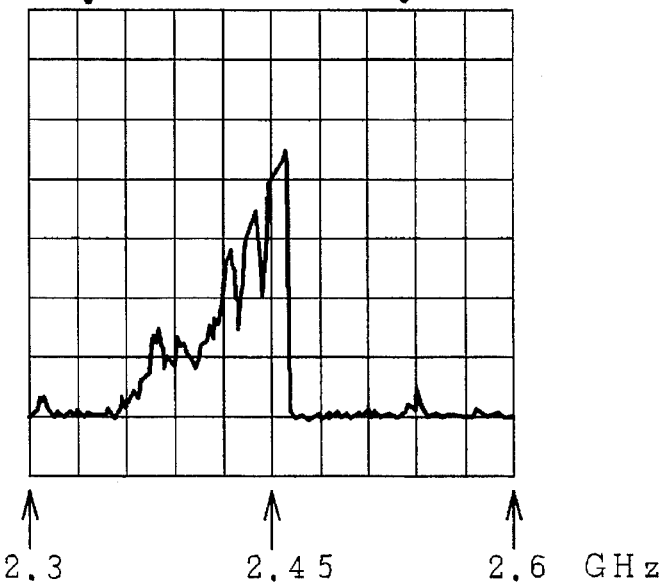
FIG. 3 (b) (PRIOR ART)

FIGS. 3 (*a*) and 3 (*b*) show the basic wave spectrum of a first embodiment of the eight-vane magnetron of this invention and that of the conventional ten-vane magnetron, respectively.

In both of FIGS. 3 (*a*) and 3 (*b*), the basic wave of the oscillation is 2450 MHz and the measuring conditions are V.S.W.R≦1.1, and with the filament current Ib 300 mA.

As a comparison between the two spectrum indicates, the oscillation spectrum of the magnetron in the embodiment of this invention has a single peak at its basic frequency, and the oscillation characteristics are very stable, as compared with those of the conventional ten-vane magnetron.

Figure 4:
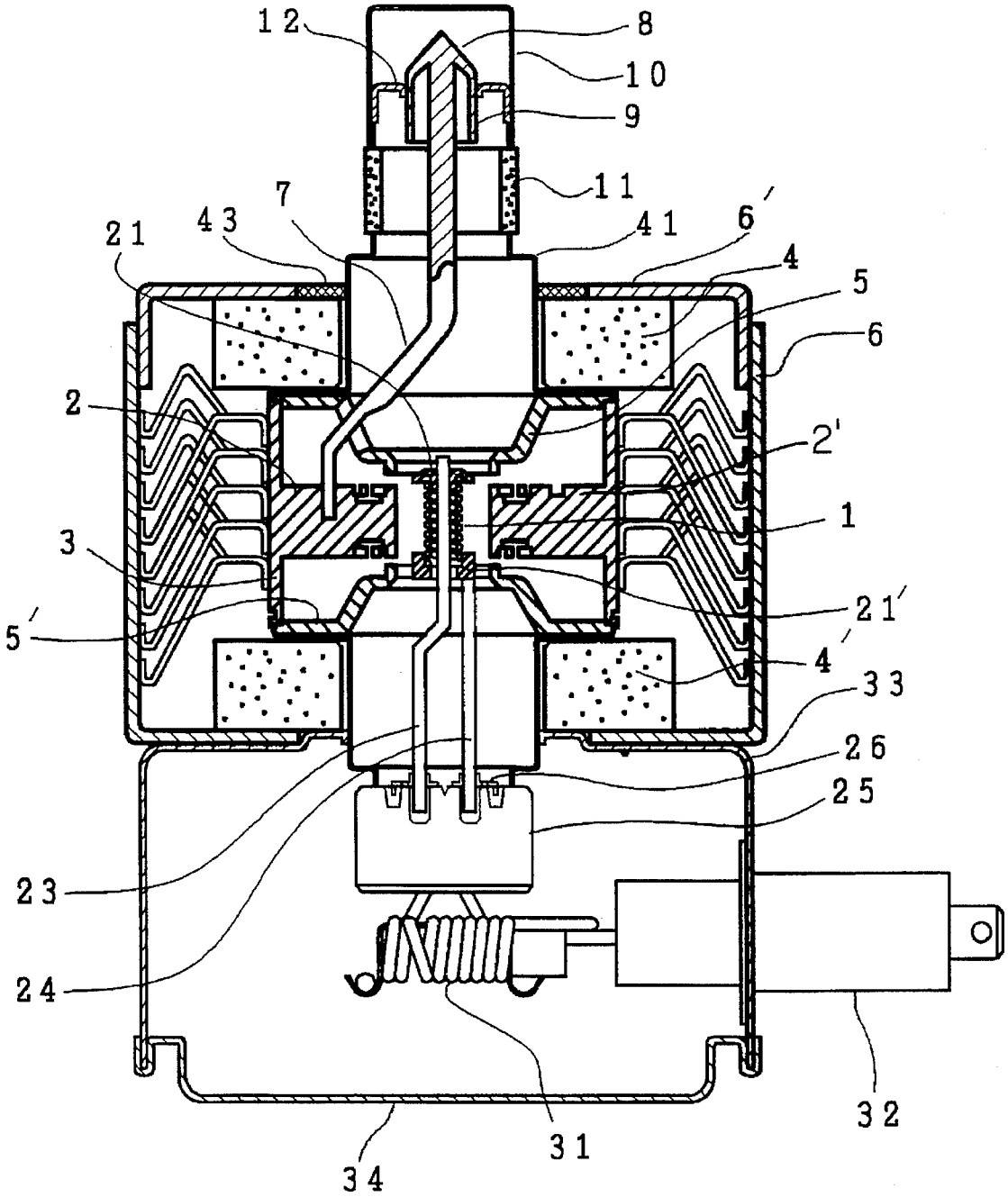
FIG. 4 shows a cross section of a magnetron of a second embodiment of the present invention.
Figure 16:
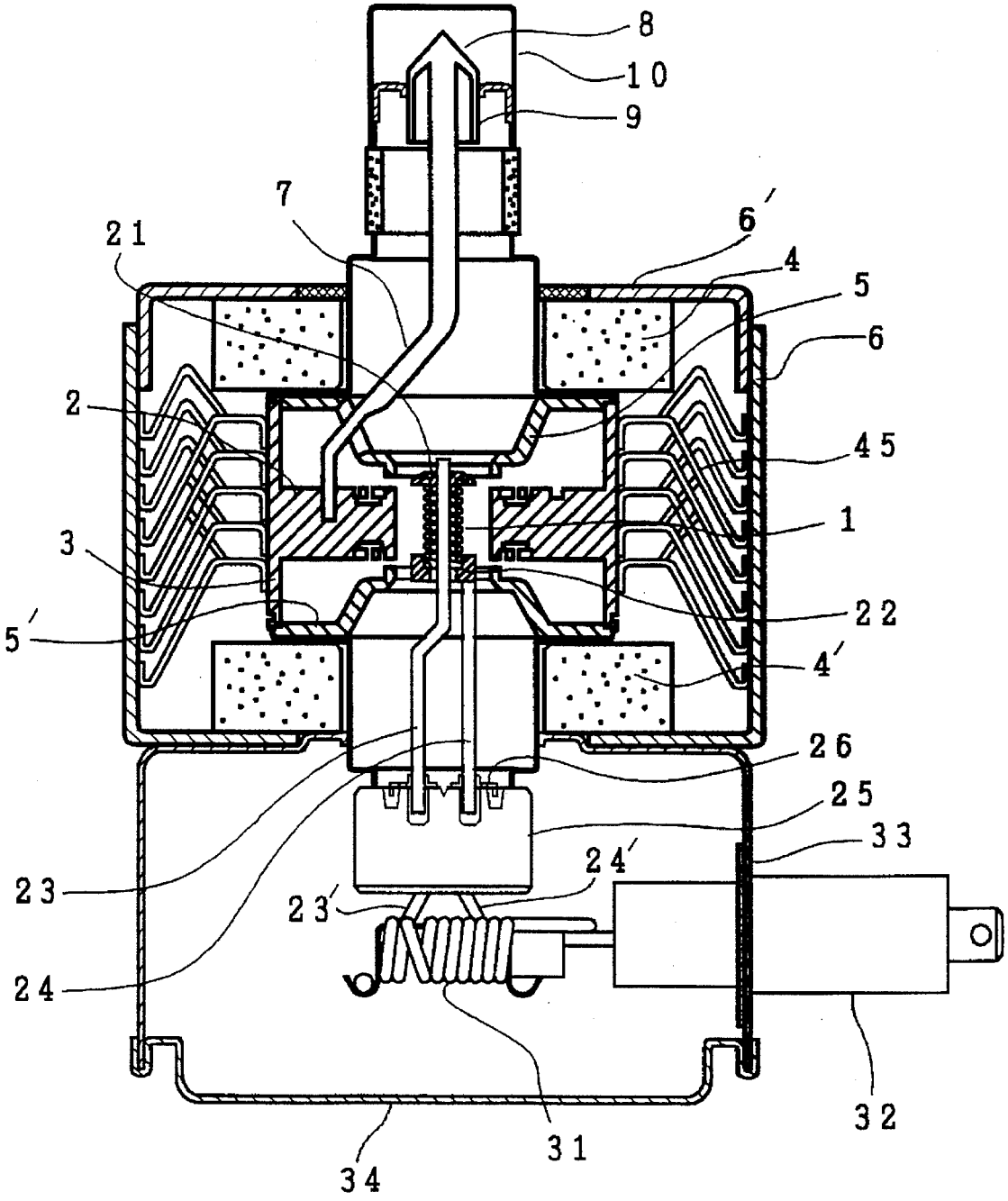
FIG. 16 (PRIOR ART)
FIG. 16 shows a cross section of another conventional magnetron structure.
Figure 17:
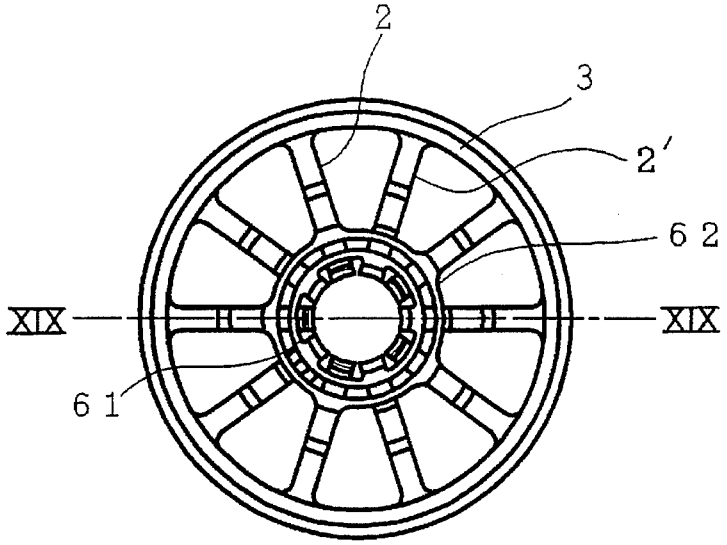
FIG. 17 (PRIOR ART)
FIG. 17 shows a top view of the conventional magnetron anode structure of FIG. 16.
Figure 18:
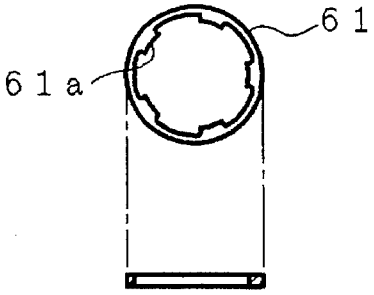
FIG. 18 (a) (PRIOR ART)
FIGS. 18 (*a*) and 18 (*b*) show strap rings of the conventional magnetron, respectively.
Figure 18:
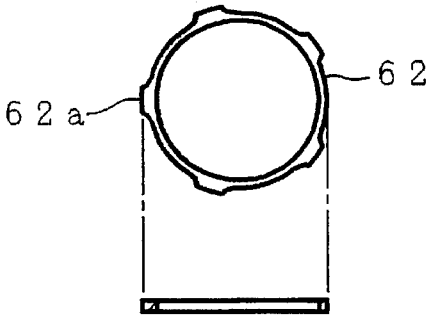
FIG. 18 (b) (PRIOR ART)
Figure 19:
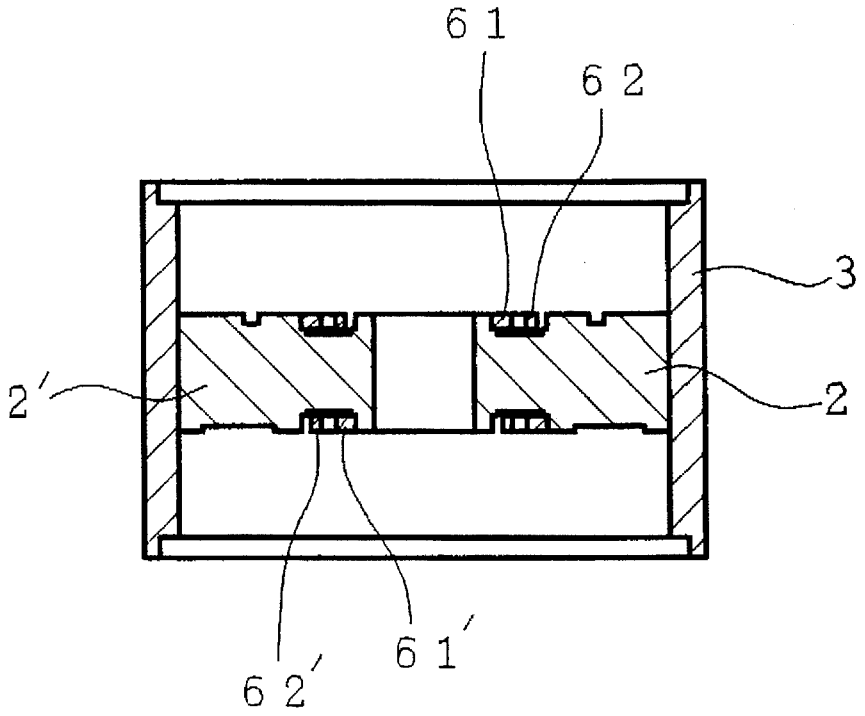
FIG. 19 (PRIOR ART)
FIG. 19 shows a longitudinal section of the conventional magnetron anode structure and is shown along line XIX—XIX in FIG. 17.

FIG. 4 shows a cross section of a second embodiment of a magnetron of this invention. The same parts as those in FIG. 16 are given the same reference numerals in FIG. 4. The magnetron of this embodiment employs eight vanes (2 and 2') in the anode cylinder. First and second strap rings are attached to the vanes only at the ends thereof on the antenna-lead-side. The configuration except for this is the same as that shown in FIG. 16. The explanation therefor is omitted here.

Figure 5:
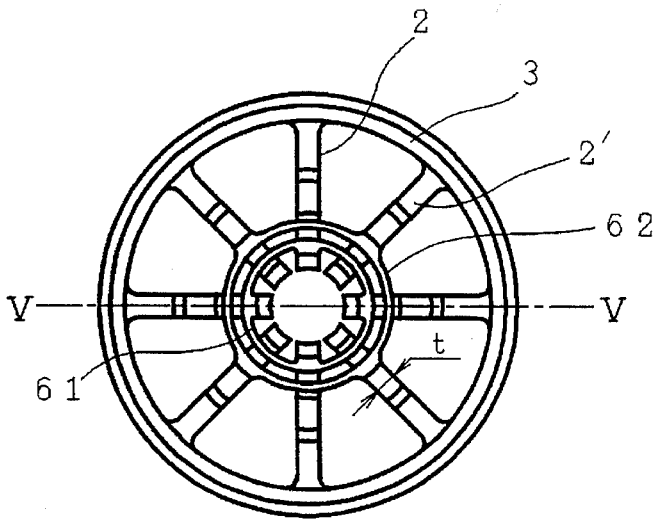
FIGS. 5 (*a*) and 5 (*b*) show, respectively, a top view and longitudinal section of the anode cylinder in the second embodiment of the magnetron of the present invention, with FIG. 5(*b*) being taken along line V—V of FIG. 5(*a*), while FIGS. 5(*c*) and 5(*d*) show, respectively, a top view of a first strap ring, and a top view of a second strap ring.
Figure 5:
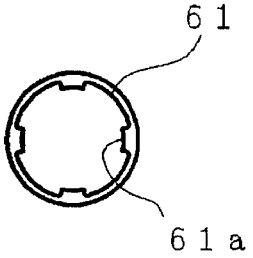
Figure 5:
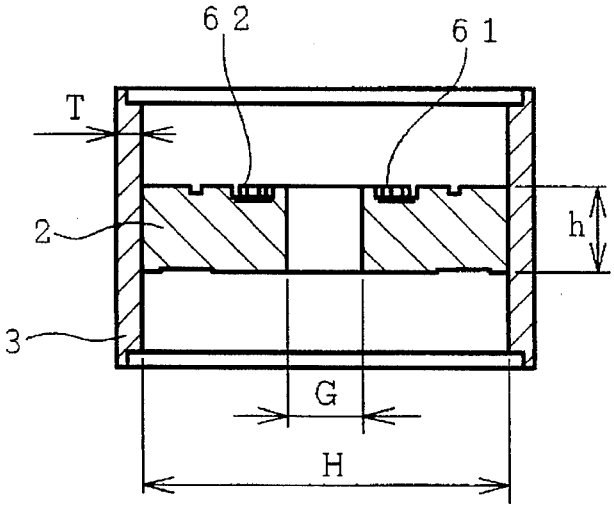
Figure 5:
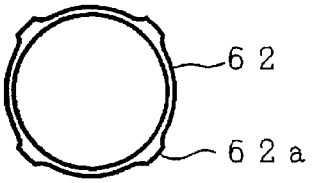

FIGS. 5 (*a*) through 5 (*d*) explain the configuration of the anode cylinder in the second embodiment of the magnetron of this invention. FIG. 5 (*a*) shows a top view from the antenna lead side. FIG. 5 (*b*) shows a cross section of the anode cylinder taken along line V—V shown in FIG. 5 (*a*). FIG. 5 (*c*) shows a top view of a first strap ring, and FIG. 5 (*d*) shows a top view of a second strap ring.

Figure 6:
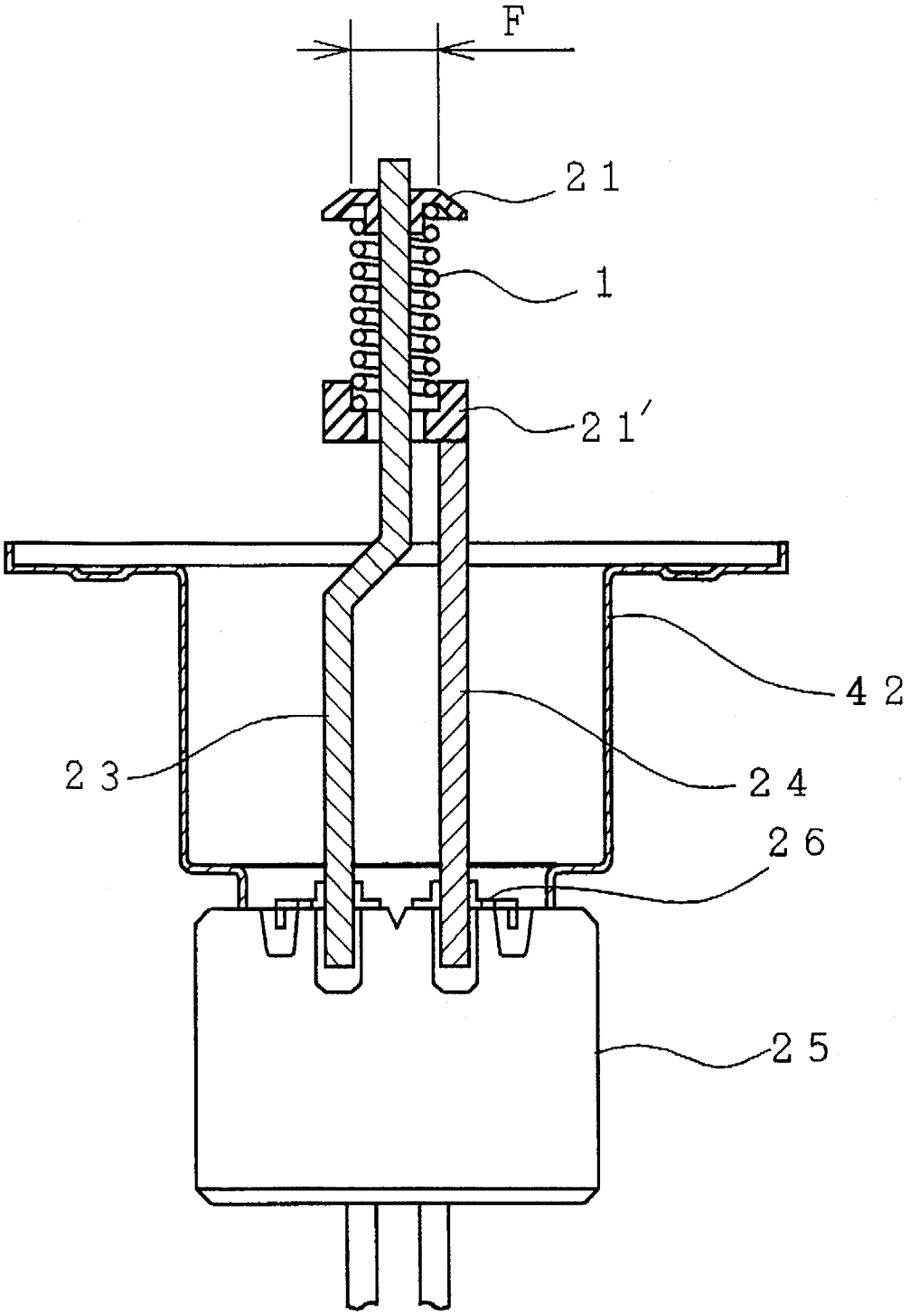
FIG. 6 shows a partial cross section of a cathode configuration in the second embodiment of the magnetron of the present invention.

FIG. 6 shows a partial cross section of the filament portion in the second embodiment of the magnetron of this invention. The same parts as those in FIG. 4 are given the same reference numerals in this figure, and 42 is a lower sealing member.

In FIGS. 5(*a*) and 5(*b*), eight vanes 2 and 2' made of copper that is 2.2 mm in thickness (f) and 8.0 mm in height (h) are arranged radially inside the anode cylinder 3 at 45° intervals.

These vanes are connected alternately through the first and second strap rings 61 and 62 that are different in diameter from each other.

The first strap ring 61 and second strap rings 62 are arranged only at the ends of the vanes on the side where the antenna lead 7 is connected to one of the vanes (FIG. 4).

Consider an anode cylinder 3 whose internal diameter H is 35.0 mm for an eight-anode-vane magnetron. The optimum thickness of the strap rings 61 and 62 is 1.1 mm because of the required relationship among the inductance L and the electrostatic capacity C of a cavity formed between anode vanes 2 and 2' and the strap rings 61 and 62 required for oscillation at 2450 MHz. This makes possible a single-side-strap-ring magnetron in which strap rings 61 and 62 are attached to only one axial side of the vanes.

Physically, the strap rings 61 and 62 can also be arranged on the ends of vanes on the side thereof opposite to the antenna leads. However, the experiments by the present inventors showed that a magnetron with the strap rings 61 and 62 arranged at the ends of vanes on the side opposite to the antenna leads suffers back-heating of the cathode, resulting in degradation of the magnetron oscillation efficiency and of the reliability of the magnetron itself. This is why they are arranged at the ends of vanes on the side thereof where the antenna leads are attached in this embodiment. If the problem is solved, however, they can be arranged at the ends of vanes on the side opposite to the antenna leads.

As shown in FIGS. 5 (*c*) and 5 (*d*), first and second strap rings 61 and 62 have projections 61*a* and 62*a* at locations to be connected with the vanes. This is because the anode cylinder and vanes are integrally press-formed into one unit in this embodiment and the shape of the grooves to fit the strap rings is common to all the vanes.

When the shape of the groove for fitting the strap rings allows individual strap rings to be connected to a vane, or when vanes 2 and 2' are silver-soldered to the anode cylinder, a simple ring or the like may be used as in the first embodiment.

From the standpoint of the oscillation efficiency and stability characteristics of the magnetron, the internal diameter G of vanes 2 and 2', shown in FIG. 5(*b*), and the external diameter F of the cathode filament 1 shown in FIG. 6 are important.

Basically, the lower the number of vanes is, the smaller the values G and F become. For the magnetron that uses eight vanes in this embodiment, the G value is 7.6 mm and the F value is 2.8 mm. If the F value is to be 2.8 mm, it is not always easy to wind a thoriated-tungsten wire helically.

Since the microwave power output of magnetrons for home microwave ovens is in the range of several hundreds to one thousand watts, the diameter of the cathode filament wire that withstands this power output is designed to be about 0.5 mm, using a thoriated-tungsten wire, considering the operating life.

To manufacture a cathode filament coil whose external diameter F is 2.8 mm, therefore, a thoriated-tungsten wire of about 0.5 mm in diameter is wound helically around a mandrel of 1.8 mm in diameter. However, it is not always so easy to obtain a filament helically coiled at a specified pitch because the mandrel is often deformed when the wire is Wound around it.

Figure 20:
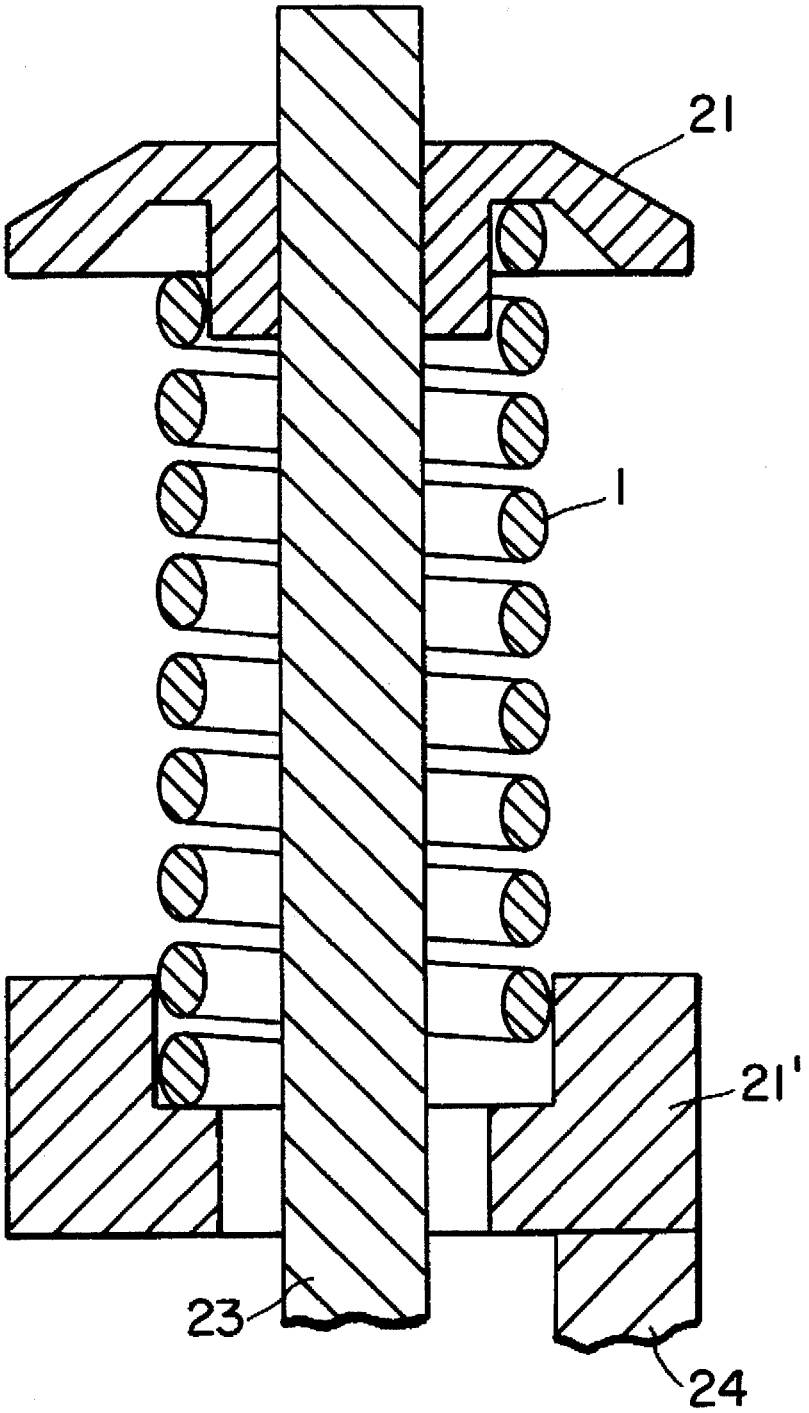
FIG. 20 shows a partial cross section of a cathode configuration in another embodiment of the present invention.

To solve this problem, the helically coiled cathode for electron tubes disclosed in Japanese Patent Laid-Open No. 215231/1992 can be adopted. With this, a helical coiled filament of F=2.8 mm can be obtained easily. In other words, in this embodiment, depicted in FIG. 20 in which the same parts as those in FIG. 6 bear the same reference numerals, a thoriated-tungsten wire whose cross section is an ellipse is used, and the wire is wound so that the major axis of the cross section is parallel with the tube axis in manufacturing the cathode filament.

The concrete size and shape of the filament is as follows: The length of the major axis of the elliptical cross section of the thoriated-tungsten wire is 0.55 mm, the length of the minor axis thereof is 0.4 mm, and the mandrel is 2.0 mm (=2.8 mm −(0.4 mm×2) in diameter.

By using these dimensions, it is easier to manufacture cathode filaments of an external diameter of 2.8 mm.

The ratio in the length of the major axis to the minor axis in an elliptical cross section of a filament is preferably in the range of 1.2 to 1.5.

For a ten-vane magnetron, the internal diameter G of anode vanes is 9.0 mm and the external diameter F of the cathode filament is 4.0 mm. As mentioned above, since the number of vanes is reduced to eight in this embodiment, both the G and F values can be reduced. With this, both the upper and lower end shields 21 and 21' can also be reduced in size, so the amount of molybdenum used for the upper and lower end shields 21 and 21' can be reduced.

The dimensions of each part of the magnetron that uses eight vanes in the above embodiment is summarized below.

External diameter F of the cathode filament=2.8 mm.

Diameter G between internal ends of vanes=7.6 mm

Internal diameter H of the anode cylinder=35 mm

External diameter I of the anode cylinder=39 mm

Each of the above values is an example. Practical dimensions for a magnetron satisfactory for microwave ovens are as shown below.

The ratio F/G, of the external diameter F of the cathode filament to the diameter between the internal ends of vanes is:

$$F/G=2.6/8.0 \text{ to } 3.2/7.0=0.32 \text{ to } 0.46$$

On the other hand, for a single-side-strap-ring magnetron in which strap rings are attached to only one axial end of the vanes, the H/G ratio is desired to be about 4.6 and usually is preferably in the range of 4.5 to 5.0.

Figure 7:
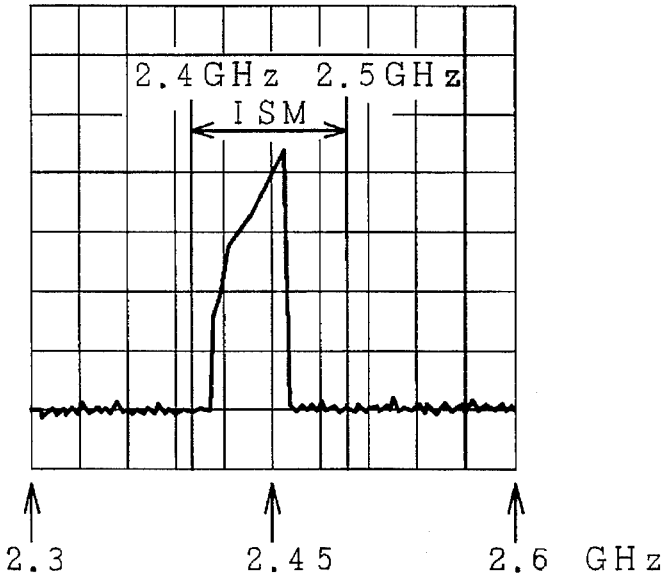
FIG. 7 (*a*) shows an oscillation spectrum of the magnetron of the second embodiment of the present invention operated in a matching condition.
Figure 7:
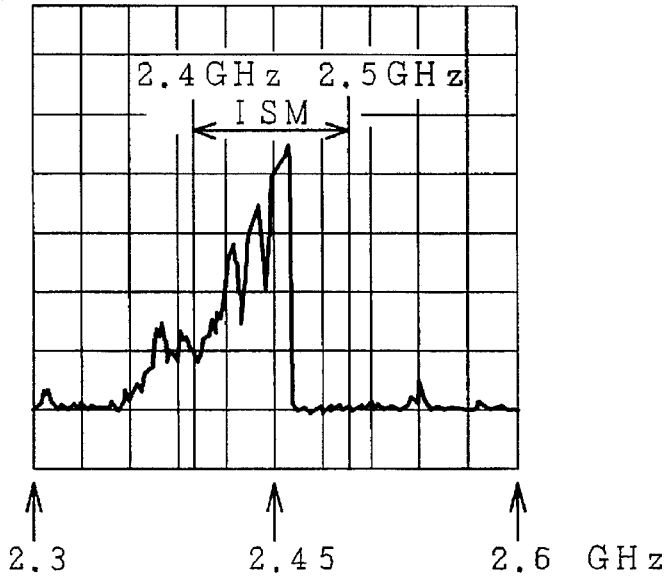
FIG. 7 (b) (PRIOR ART)

FIGS. 7 (*a*) and 7 (*b*) show the oscillation spectrums of an eight-vane magnetron of this embodiment and a conventional ten-vane magnetron, respectively, when each magnetron is operated in the impedance matching condition optimized between an impedance matching condition in which the obtainable power output is large, but the oscillation frequency changes considerably with a small change in impedance, and another impedance matching condition in which the obtainable power output is smaller, but the oscillation frequency is very stable.

The oscillation spectrum of the magnetron of this embodiment shown in FIG. 7 (*a*) is that of the eight-vane magnetron in which the external diameter F of the cathode filament is 2.8 mm, the diameter G between the internal ends of vanes is 7.6 mm, and the internal diameter H of the anode cylinder is 35 mm.

When FIG. 7 (*a*) is compared with FIG. 7 (*b*), it is clear that the oscillation spectrum of the present embodiment shown in FIG. 7 (*a*) has a wider margin with respect to the frequency band width allowed for magnetrons (that is, the frequency band (2400 to 2500 MHz) legally prescribed for industrial, scientific and medical (ISM) applications) than that of the conventional magnetron shown in FIG. 7 (*b*).

Figure 8:
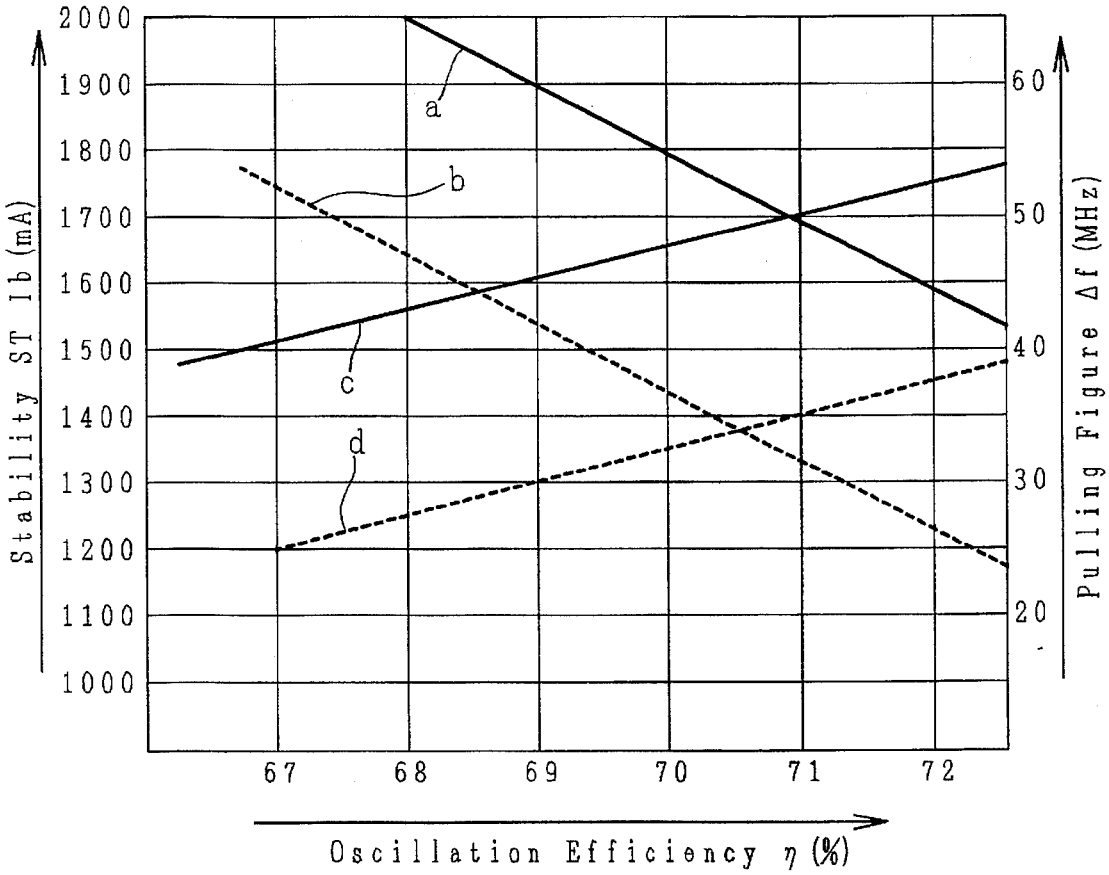
FIG. 8 illustrates operating stability and pulling figure versus oscillation efficiency in a magnetron of the second embodiment of the present invention and in a conventional ten-vane magnetron.

FIG. 8 indicates the operation stability and pulling figure against the magnetron oscillation efficiency for the magnetron of this embodiment and the conventional ten-vane magnetron.

In FIG. 8, the line a indicates the stability (ST Ib mA) of the eight-vane magnetron of this embodiment, the line b indicates the stability of the conventional ten-vane magnetron, the line c indicates the pulling figure (Δf MHz) of the eight-vane magnetron of this embodiment, and the line d indicates the pulling figure of the conventional ten-vane magnetron.

As shown in the figure, the operating stability of the magnetron of this embodiment is about 1.3 times higher than that of the conventional one for the same efficiency. The pulling figure of the magnetron of this embodiment is also about 1.4 times higher than that of the conventional one. This means that the magnetron of this embodiment can supply microwave power stably and it is easier to use.

As explained above, the magnetron of this embodiment can be reduced in size by reducing the number of anode vanes, and the required amount of expensive oxygen-free copper and molybdenum can be reduced. This will contribute to saving of global resources. Above all, the present invention provides a better oscillation spectrum and increased operating stability than the conventional magnetron.

Figure 9:
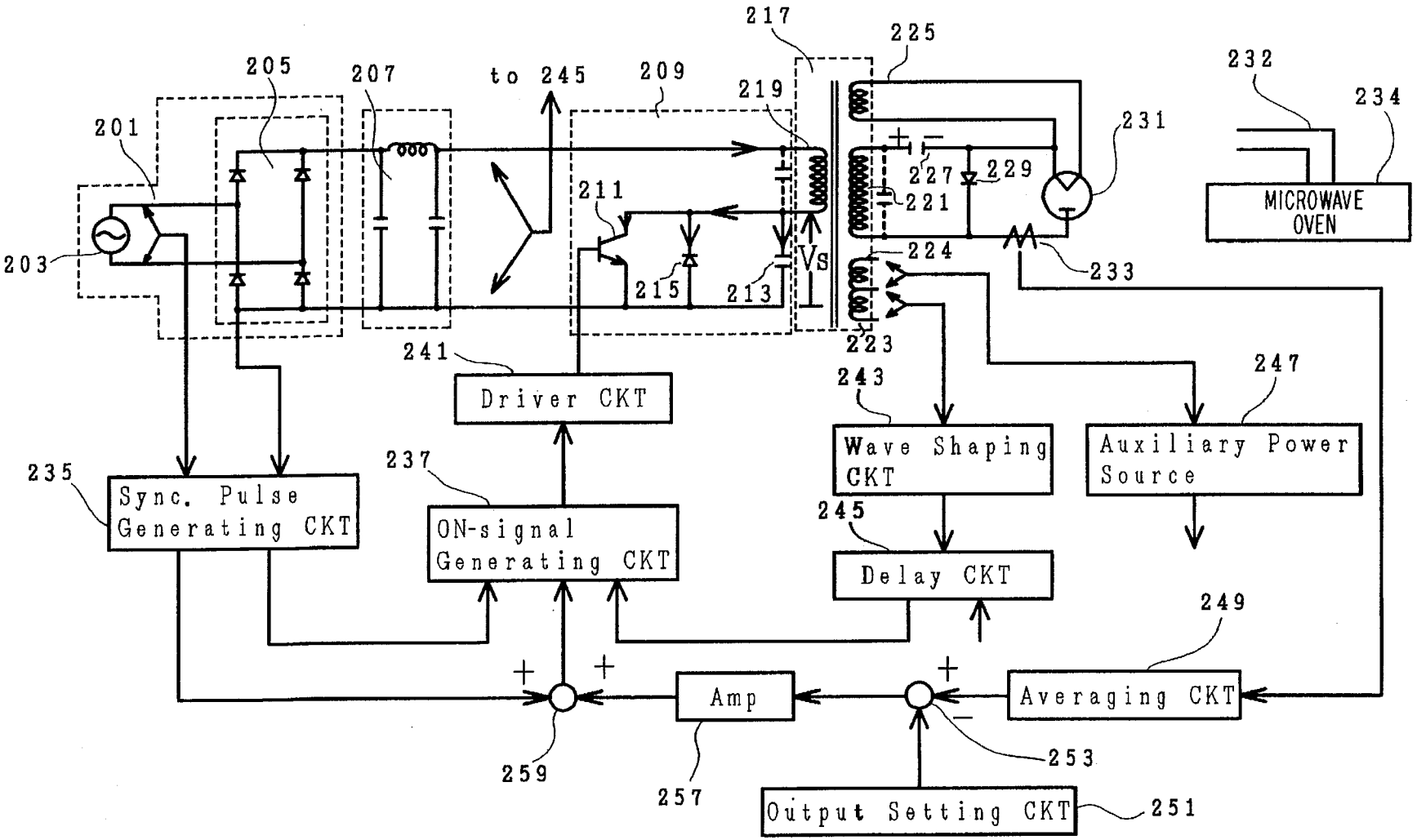
FIG. 9 shows an example of a microwave oven circuit for use with a magnetron of the present invention.
Figure 12:
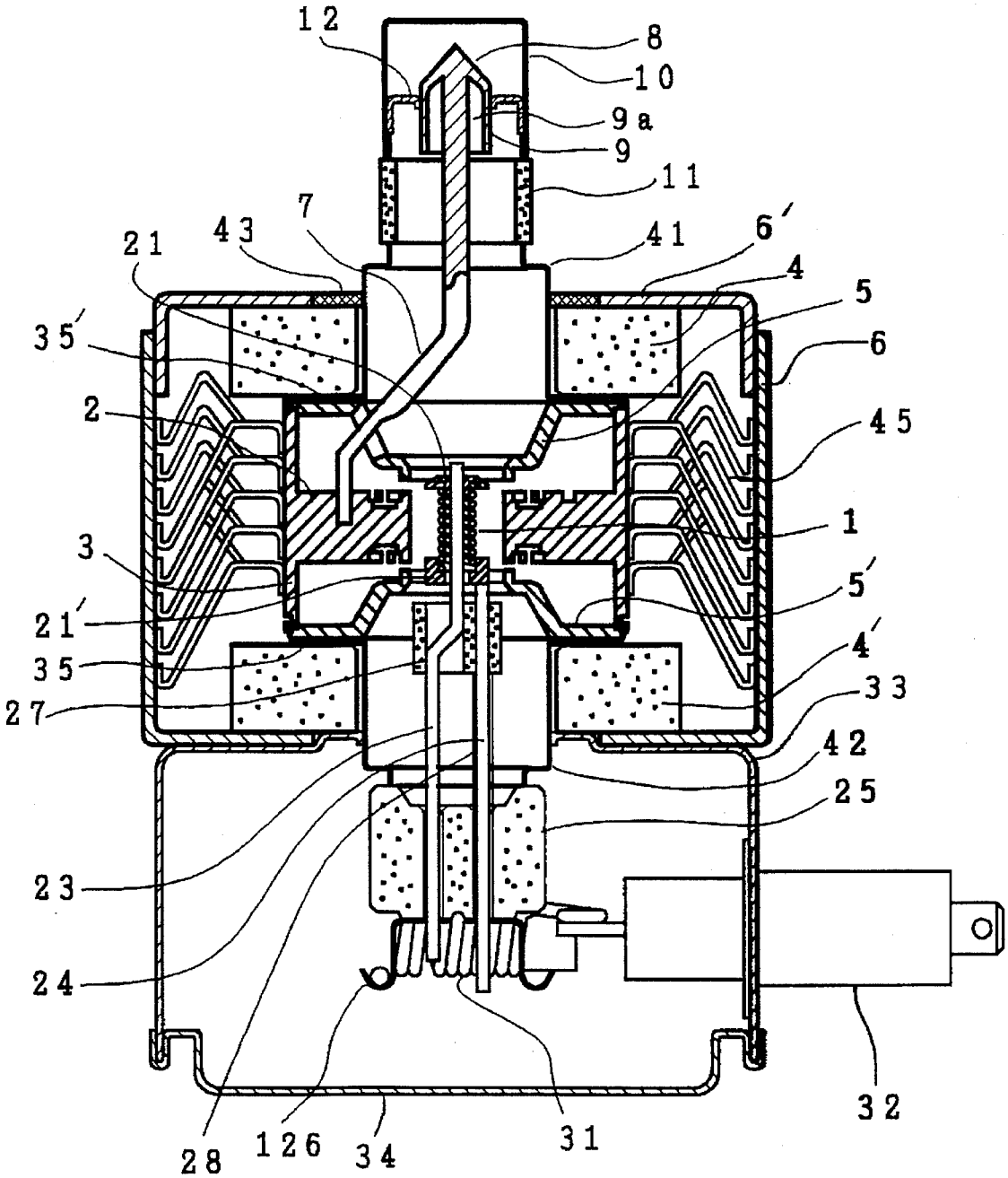
FIG. 12 (PRIOR ART)
FIG. 12 shows a cross section of an example of a conventional magnetron structure.
Figure 13:
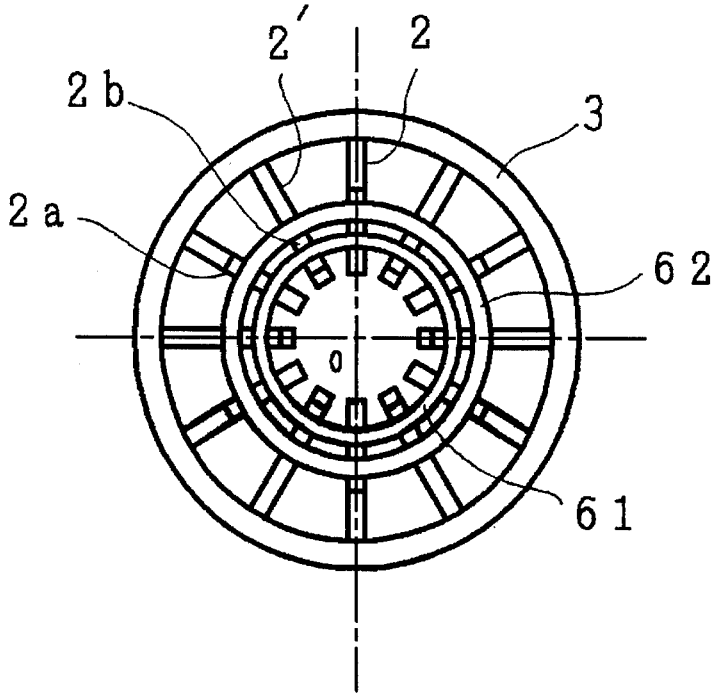
FIG. 13 (PRIOR ART)
FIG. 13 shows a top view of the conventional magnetron anode structure shown in FIG. 12.
Figure 14A:
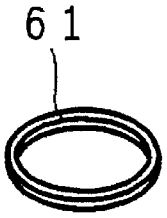
FIG. 14(a) (PRIOR ART)
FIGS. 14(*a*) and 14(*b*) show perspective views of the strap rings shown in FIG. 13.
Figure 14B:
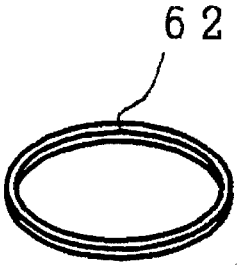
FIG. 14(b) (PRIOR ART)
Figure 15:
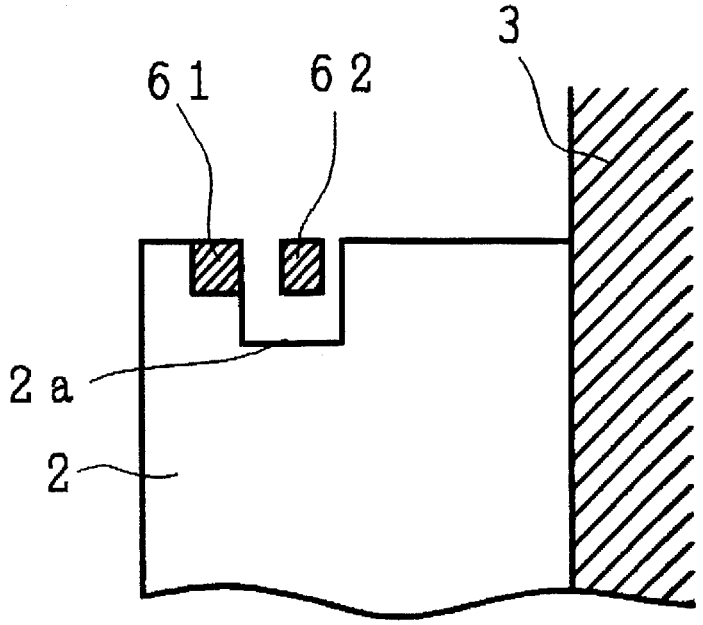
FIG. 15 (PRIOR ART)
FIG. 15 shows a cross section of an essential part of one of anode vanes to explain how the anode vane is connected to a strap ring.

FIG. 9 illustrates the configuration of a microwave oven circuit for use with the magnetron of this invention.

In FIG. 9, 231 is the magnetron. The DC power supply 201 that supplies DC power to the switching power unit 209 comprises a commercial AC power supply 203 and a full-wave rectifier circuit 205. A filter 207 is connected to the DC output terminals of the full-wave rectifier circuit 205. The filter 207 comprises a reactor and a capacitor used to prevent the microwave noise contained in the oscillation current of the magnetron 231 from leaking through the AC power supply.

The switching power unit 209, including a transistor 211, is turned ON or OFF by the driver circuit 241 driven by the ON-signal from the ON-signal generating circuit 237 controlled by synchronizing pulses generated by the synchronizing pulse generating circuit 235.

The switching power unit 209 includes the damper diode 215 connected in parallel with the transistor 211 (poled in the opposite sense) and also includes the resonant capacitor 213 connected in parallel with the transistor 211. This switching power unit 209 is connected to a step-up transformer 217 that has the primary winding 219 and the secondary windings 221, 223, 224, and 225. The primary winding 219 is connected to the filter 207 through the switching power unit 209, forming a series resonant circuit together with the capacitor 213.

The secondary winding 221 is connected to the magnetron 231 through the voltage doubling rectifier circuit comprising a capacitor 227 and a high voltage diode 229. The load current flowing through the magnetron 231 is detected by the current detector 233, and the detected current is averaged by the averaging circuit 249. The difference between the averaged current and the value set by the output setting circuit 251 is determined by comparator 253 and is amplified by the amplifier 257 and is provided to the ON-signal generating circuit 237 as a control signal after being added in comparator 259 with synchronizing pulses from the synchronizing pulse generating circuit 235.

The secondary winding 225 is provided to heat the filament of the magnetron 231. The secondary winding 223 is used to generate an output feedback voltage. This output voltage is shaped in the wave-shaping circuit 243, then delayed by a specified period of time by the delay circuit 245 and given to the ON signal generating circuit 237 as a control signal.

The current from the secondary winding 224 is outputted to the auxiliary power supply 247 and rectified and used as a power source for the control circuit, etc.

Usually a high voltage of a few kV is applied across the filament and the anode of the magnetron 231.

In FIG. 9, 232 is a waveguide and 234 is the cooking chamber of a microwave oven. The microwave generated in the magnetron 231 is supplied to the cooking chamber 234 through the waveguide 232 to heat the object in the cooking chamber.

FIG. 10 compares the output characteristics of the eight-vane magnetron of this invention and those of the conventional ten-vane magnetron for various loads when they are used in a 900 W class microwave oven. In this figure, "Pabs" indicates the output power of the microwave oven (oven output), "Win" indicates the input power to the microwave oven. "η oven" indicates Pabs/Win×100(%).

As shown in the figure for the same power values, the η oven value of the microwave oven that uses the magnetron of this invention is larger than that of the microwave oven that uses the conventional magnetron.

In other words, the magnetron of this invention can be reduced in size by reducing the number of anode vanes, the material can also be saved and the operating characteristics can be improved significantly.

As explained above, according to this invention, the following advantages can be obtained.

(1) The amount of copper for the vanes and the anode cylinder can be reduced by reducing the number of vanes to eight and reducing the anode cylinder in diameter.

(2) Even in case of the material-saving type anode structure, no problem arises with performance in practical use of the magnetron for use with 1 kW or less class home microwave ovens if the diameter between internal ends of vanes and the cathode external shape are optimized.

(3) As a secondary advantage, the oscillation spectrum band width can be narrowed by reducing the number of anode cavities from the conventional ten to eight. Thus, enough margin of the oscillation spectrum can be secured with respect to the band width allowed for magnetrons for microwave ovens, that is, the ISM band (2450≈50 MHz).

What is claimed is:

1. A magnetron, comprising:

an anode cylinder, eight vanes extending radially inwardly from said anode cylinder, a helically coiled, directly heated filament extending along a center axis of said anode cylinder, and an antenna lead having a first end connected to an axial end of one of said eight vanes on a first axial end side thereof and a second end connected to an antenna, whereby said magnetron oscillates at a basic frequency of 2450 MHz, wherein said helically coiled, directly heated filament has an external diameter in the range of 2.6 to 3.2 mm, and the internal ends of said eight vanes define a diameter in the range of 7.0 to 8.0 mm.

2. The magnetron according to claim 1, further comprising strap rings electrically connecting said eight vanes alternately at the first axial end side and a second axial end side thereof.

3. The magnetron according to claim 2, wherein each of said plurality of vanes has a thickness in the range of 2.0 to 2.4 mm and an axial height in the range of 6.4 to 8.4 mm.

4. The magnetron according to claim 2, wherein said anode cylinder has an internal diameter in the range of about 3.6 to about 4.6 times the diameter defined by said internal ends of said eight vanes.

5. The magnetron according to claim 4, wherein each of said plurality of vanes has a thickness in the range of 2.0 to 2.4 mm and an axial height in the range of 6.4 to 8.4 mm.

6. The magnetron according to claim 1, wherein said anode cylinder has an internal diameter in the range of about 4.5 to about 5.0 times the diameter defined by said internal ends of said eight vanes.

7. The magnetron according to claim 6, wherein each of said plurality of vanes has a thickness in the range of 2.0 to 2.4 mm and an axial height in the range of 6.4 to 8.4 mm.

8. The magnetron according to claim 1, wherein each of said plurality of vanes has a thickness in the range of 2.0 to 2.4 mm and an axial height in the range of 6.4 to 8.4 mm.

9. The magnetron according to claim 1, further comprising strap rings electrically connecting said eight vanes alternately only at said first axial end side thereof.

10. The magnetron according to claim 9, wherein each of said plurality of vanes has a thickness in the range of 2.0 to 2.4 mm and an axial height in the range of 6.4 to 8.4 mm.

11. The magnetron according to claim 9, wherein said anode cylinder has an internal diameter in the range of about 4.5 to about 5.0 times the diameter defined by said internal ends of said eight vanes.

12. The magnetron according to claim 1, wherein said anode cylinder has an internal diameter in the range of about 3.6 to about 4.6 times the diameter defined by said internal ends of said eight vanes.

13. The magnetron according to claim 12, wherein each of said plurality of vanes has a thickness in the range of 2.0 to 2.4 mm and an axial height in the range of 6.4 to 8.4 mm.

14. The magnetron according to claim 1, wherein said helically coiled, directly heated filament comprises a wire having an elliptical cross section.

15. The magnetron according to claim 14, wherein the ratio of the length of the major axis of said elliptical cross section to the length of the minor axis of said elliptical cross section is in the range of 1.2 to 1.5.

16. A magnetron comprising:

an anode cylinder;

eight vanes extending radially inwardly from said anode cylinder, a helically coiled, directly heated filament extending along a center axis of said anode cylinder, an antenna, and an antenna lead having a first end connected to an axial end of one of said eight vanes on a first axial end side thereof and a second end connected to said antenna, whereby said magnetron oscillates at a basic frequency of 2450 MHz, wherein the ratio F/G of an external diameter F of said helically coiled, directly heated filament to a diameter G defined by the internal ends of said eight vanes is in the range of 0.32 to 0.46, and said helically coiled, directly heated filament has an external diameter in the range of 2.6 to 3.2 mm.

17. A magnetron comprising:

an anode cylinder;

eight vanes extending radially inwardly from said anode cylinder, a helically coiled, directly heated filament extending along a center axis of said anode cylinder, an antenna, an antenna lead having a first end connected to an axial end of one of said eight vanes on a first axial end side thereof and a second end connected to said antenna, and strap rings electrically connecting said eight vanes alternately only at said first axial end side thereof, whereby said magnetron oscillates at a basic frequency of 2450 MHz, wherein the ratio F/G of an external diameter F of said helically coiled, directly heated filament to a diameter G defined by the internal ends of said eight vanes is in the range of 0.32 to 0.46, and the ratio H/G of an internal diameter H of said anode cylinder to said diameter G is in the range of 4.5 to 5.0.

* * * * *